US005503403A

United States Patent [19]

Morrell

[11] Patent Number: 5,503,403

[45] Date of Patent: Apr. 2, 1996

[54] THREE-DIMENSIONAL ARCHERY TARGET

[76] Inventor: Dale A. Morrell, Rte. 2, Box 699, Alma, Ark. 72921

[21] Appl. No.: 214,198

[22] Filed: Mar. 17, 1994

Related U.S. Application Data

[63] Continuation-in-part of Ser. No. 24,395, Mar. 1, 1993, Pat. No. 5,308,084.

[51] Int. Cl.[6] ..... F41J 3/00

[52] U.S. Cl. ..... 273/403; 273/408

[58] Field of Search ..... 273/403, 404, 273/407, 408, 372, 374

[56] References Cited

U.S. PATENT DOCUMENTS

| | | | |
|---|---|---|---|
| 2,812,947 | 11/1958 | Fatzinger | 273/404 |
| 3,163,418 | 12/1964 | Myers | 273/408 |
| 3,586,331 | 6/1971 | Tickell, Jr. | 273/372 |
| 4,054,288 | 10/1977 | Perrine, Sr. | 273/407 |
| 4,203,600 | 5/1980 | Brown | 273/407 |
| 4,477,082 | 10/1984 | McKenzie et al. | 273/403 |
| 4,565,376 | 1/1986 | Croll | 273/408 |
| 4,630,832 | 12/1986 | Swanson | 273/374 |
| 4,643,434 | 2/1987 | Carlin | 273/408 |
| 4,850,596 | 7/1989 | Olund | 273/408 |
| 5,002,285 | 3/1991 | Morrell | 273/408 |
| 5,308,084 | 5/1994 | Morrell | 273/403 |

OTHER PUBLICATIONS

Gander Mountain Archery 1993 Catalog, front cover and pp. 2, 52, 53, and 54.

ETHAFOAM Animal Targets, Stanley Hips Targets, San Antonio, Texas, Sep. 19, 1984. 4 pp. 273–403.

*Primary Examiner*—William H. Grieb

*Attorney, Agent, or Firm*—Daniel R. Alexander; Head, Johnson & Kachigian

[57] ABSTRACT

A three-dimensional life-size game animal-simulating archery target including a foam body shaped in the form of a game animal, such as a deer, elk, moose, bear, wild boar, etc., and having a target insert receiving recess located in a primary aiming point of the target. A removable target insert adapted for use with broad head arrows, field point arrows, or both, is releasably secured in the recess in the foam body, and a removable body cover placed over the insert and recess to provide a uniform visual appearance to the exterior of the game animal. A three-dimensional game animal archery target system includes a foam body shaped in the form of a game animal together with at least two removable target inserts, one being adapted for use with broad head arrows and the other being adapted for use with target point or field point arrows. Such a system provides the user with the ability to utilize the same target for archery target practice and hunting preparation with both field point and broad head arrows. The removable target insert is a substantially cylindrical rectangular or oval, elongate item sized so as to be received within and substantially fill the recess in the foam body and is constructed of either foam for use with broad head arrows or burlap sacks filled with packing material and having a penetration resistant central core for use with field point and target point arrows.

18 Claims, 6 Drawing Sheets

THREE-DIMENSIONAL ARCHERY TARGET

CROSS-REFERENCE TO RELATED APPLICATIONS

This application is a continuation-in-part of allowed application Ser. No. 08/024,395, filed on Mar. 1, 1993, now U.S. Pat. No. 5,308,084, issued May 3, 1994.

BACKGROUND OF THE INVENTION

The present Invention Is directed to archery targets, and, more particularly, concerns a three-dimensional animal-simulating archery target having an animal-shaped body and a replaceable target insert. The archery target is adapted for use with broad head or field point arrows, and, since the target simulates a game animal, it provides not only for target practice but also provides an experience closely related to actual bow hunting of game animals.

Conventional three-dimensional life-size animal-simulating archery targets having the target formed from a single piece of molded foam having a shape resembling that of a game animal, for example a deer, suffer from several drawbacks. First, the primary target area located in the kill area or vital area of the upper chest cavity is the primary aiming point and relatively quickly destroyed due to repeated strikes with arrows and the entire target must be replaced. Replacement of the entire foam target involves a substantial expenditure, especially when relatively large targets are concerned. This problem is accentuated when broad head arrows are used for target practice.

Another drawback related to the use of the single piece three-dimensional animal-simulating archery target is the selection of the weight of foam used for target construction. The entire target must be constructed of a relatively dense, heavy and expensive foam material, such as 5 or 6 lbs/cu/ft polyurethane foam. Further, the foam selected to construct the entire target must be adapted for use with both broad head and field point arrows. If the foam material is not dense enough, the arrows which strike the target may completely penetrate therethrough or penetrate so far that the feathers on the rear of the arrow are entangled in the foam material causing costly arrow damage.

One attempt at addressing some of the above-described drawbacks of the single piece foam target is described in U.S. Pat. No. 4,477,082 issued to McKenzie et al. and entitled "Archery Target With Replaceable Target Segments". The archery target is disclosed as having first and second body segments having a shape simulating the forward and rearward extremities respectively of an animal and a replaceable central target segment having a shape corresponding to the central trunk of the animal. The central replaceable target segment is releasably joined to the forward and rearward body segments by vertical male and female dovetails. The target was intended to reduce the costs involved with the use of three-dimensional foam archery targets by having a replaceable target segment which is removed and replaced following extended use of the target, while the forward and rearward body segments are reused together with a new target segment. However, since the replaceable target segment comprises approximately one-third of the total target area, it is relatively expensive to replace. Further, during actual use of such a target, the vertical dovetails holding the segments together tend to come apart with repeated arrow strikes due to the dynamic force of the arrows impacting the target segment. In an attempt to keep the target together, one may add cement, glue, or foam adhesive between the target segments, but, in so doing, they destroy the replaceability of the central target segment. Once this is done, following extended use and disintegration of the target segment, the entire target has to be replaced.

U.S. Pat. No. 4,565,376, issued to Croll, and entitled "Animal-Simulating Three-Dimensional Archery Target and Method of Manufacture" discloses an archery target wherein transversely gathered thermoplastic film is wrapped into the shape of an animal and the wrapped shape is covered with thermoplastic sheeting heat-sealed to the wrapped film. The shape is filled with additional transversely gathered plastic film folded upon itself and inserted into the wrapped film shape. The plastic film material has a self-closing or healing characteristic intended to permit the target to resist destruction and increase the service life of the target. Such a material is not suitable for use with broad head arrows because the plastic material will close in around the back of the arrowhead making it difficult to remove.

Hence, there is a need for am improved three-dimensional life-size animal-simulating archery target which is adapted for use with both broad head or field point arrows, which does not fall apart during use, and which provides for a relatively long service life at reduced cost.

SUMMARY OF THE INVENTION

In accordance with the present invention, a three-dimensional life-size animal-simulating archery target is provided which includes an animal-shaped foam body and a removable target insert adapted for placement in an insert retaining recess in the animal body and serving as the primary aiming point and arrow receiving component of the archery target.

In accordance with one embodiment of the present invention, the three-dimensional life-size animal-like archery target includes a foam body shaped in the form of a game animal and composed of molded sections. Further, the target includes a target insert received within a target insert receiving recess in the foam animal body between the front arid rear shoulders thereof. Further, the archery target includes a body cover or jacket adapted to cover the target insert and receiving recess so as to provide a uniform appearance to the exterior of the animal. The body cover may include a bull's eye, scoring rings, or vital organ indicators providing a primary aiming point during target practice and being located over the central area of the target insert.

The body cover and target insert are relatively inexpensive and easily removed and replaced following extended use while the foam animal-shaped body is retained for further use with a new target insert and body cover. Thus, the archery target of the present invention provides a relatively low cost archery practice system since the foam animal-shaped body can be used over and over through many seasons or tournaments while the relatively inexpensive target inserts and body covers are replaced as necessary.

In accordance with another aspect of the present invention, a three-dimensional life-size animal-like archery target system adapted for use with both broad head and field point arrows includes a foam animal-shaped body laving a target insert receiving recess located in a kill area or primary aiming point of the animal, and at least two different target inserts, one being adapted for use with broad head arrows and the other being adapted for use with field point or target head arrows.

In accordance with an exemplary embodiment, the target insert adapted for use with broad lead arrows is made up of a substantially cylindrical elongate section of polyurethane foam having embedded therein a block of penetration resistant ETHAFOAM. Also, in accordance with an exemplary embodiment, the target insert adapted for use with field point or target lead arrows is a substantially cylindrical elongate fabric covered item having a free floating central core formed by a plurality of stacked sheets of a penetration resistant material surrounded by compressed packing material. The central core and compressed packing material are enclosed by a moisture barrier which itself is wrapped with a plurality of layers of a mesh material having openings dimensioned so as to freely pass an arrow tip, and an outer fabric cover surrounding the mesh material. In accordance with a preferred embodiment the free floating central core is formed by a plurality of stacked sheets of woven burlap fabric, the compressed packing material is cotton molt, the moisture barrier is a polyethylene bag, the mesh material is nylon mesh having openings at least one-fourth of an inch in diameter, and the fabric cover is burlap fabric. Such a target insert has a long service life and allows arrows to be easily removed. Once arrows strike the target insert, they are maintained in an orientation perpendicular to the front face of the insert, minimizing their exposure to subsequent arrows, and thus preventing expensive arrow damage.

In order to prevent arrows from passing through the archery target between the base of the insert receiving recess and the lower edge of the target insert, a rectangular ETHAFOAM block is added between the foam body and the target insert.

The principal object of the present invention is the provision of a three-dimensional animal simulating archery target having a replaceable target insert located in the primary aiming point of the archery target.

Another object of the present invention is the provision of a three-dimensional archery target system which is adapted for use with both broad head and field point arrows.

A still further object of the present invention is the provision of a target insert adapted for use with a three-dimensional life-size animal-simulating archery target having an insert receiving recess located in a kill zone of the animal.

Still yet another object of the present Invention is the provision of a three-dimensional archery target including a foam animal-shaped body, a removable target Insert, and a removable body cover.

Another object of the present invention is the provision of a replaceable target component including a target insert and a body cover.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENTS

Figure 1:
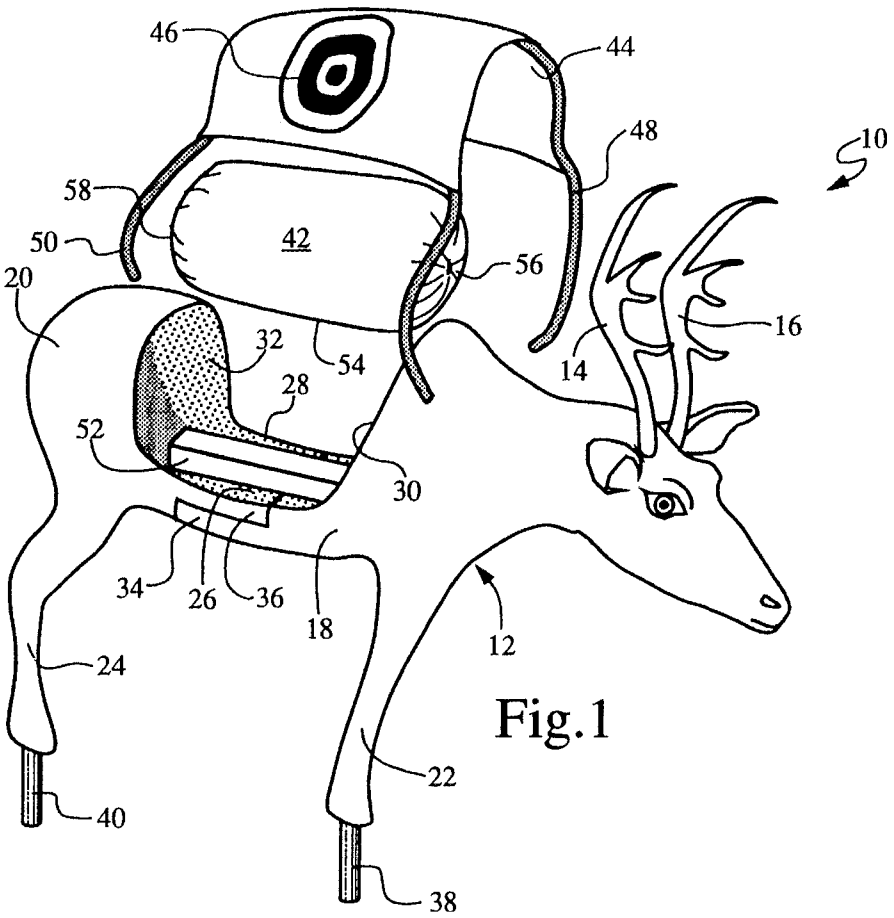
FIG. 1 is an exploded perspective view representation of the three-dimensional archery target in accordance with one embodiment of the present invention.

In accordance with an exemplary embodiment of the present invention as shown in FIG. 1 of the drawings, a three-dimensional life-size animal-simulating archery target is generally designated by the reference numeral 10 and shown to include a foam body 12 having a deer-like shape and including removable antlers 14 and 16, and front and rear body sections 18 and 20 each having respective front and rear legs 22 and 24. The foam body 12 further includes a target insert receiving recess 26 made up of a large opening or cutout 28 in the back of the animal and front and rear cavities 30 and 32. The foam body 12 is constructed of molded polyurethane foam having a density of from two to nine lbs/cu/ft, preferably six lbs/cu/ft. The front and rear body sections 18 and 20 of foam body 12 have overlapping and interfitting flanges 34 and 36 which are joined together in the belly area of the animal. A section of steel pipe or conduit 38 and 40 is molded into the base of each of the legs 22 and 24 to provide for the mounting of the archery target 10 in an upright operative position for use, for example, over metal stakes that are driven into the ground.

The three-dimensional archery target 10 further includes an elongate, substantially cylindrical target insert 42 adapted to be received in and substantially fill the insert receiving recess 26 of foam body 12. The target further includes a body cover 44 for covering the target insert 42 and recess 26 so as to provide a uniform appearance to the exterior of the game animal. The body cover 44 includes a bull's eye or scoring rings 46 on the exterior thereof to indicate the primary aiming point for arrows directed at the target 10. The bull's eye 46 is preferably located on the exterior of the body cover positioned to overlie the central region of the target insert 42 when the insert is located in an operative position within the insert receiving recess 26 and the body cover is secured to the exterior of the foam body 12. The body cover 44 includes front and rear draw strings 48 and 50 for securing the body cover to the foam body 12.

Figure 7:
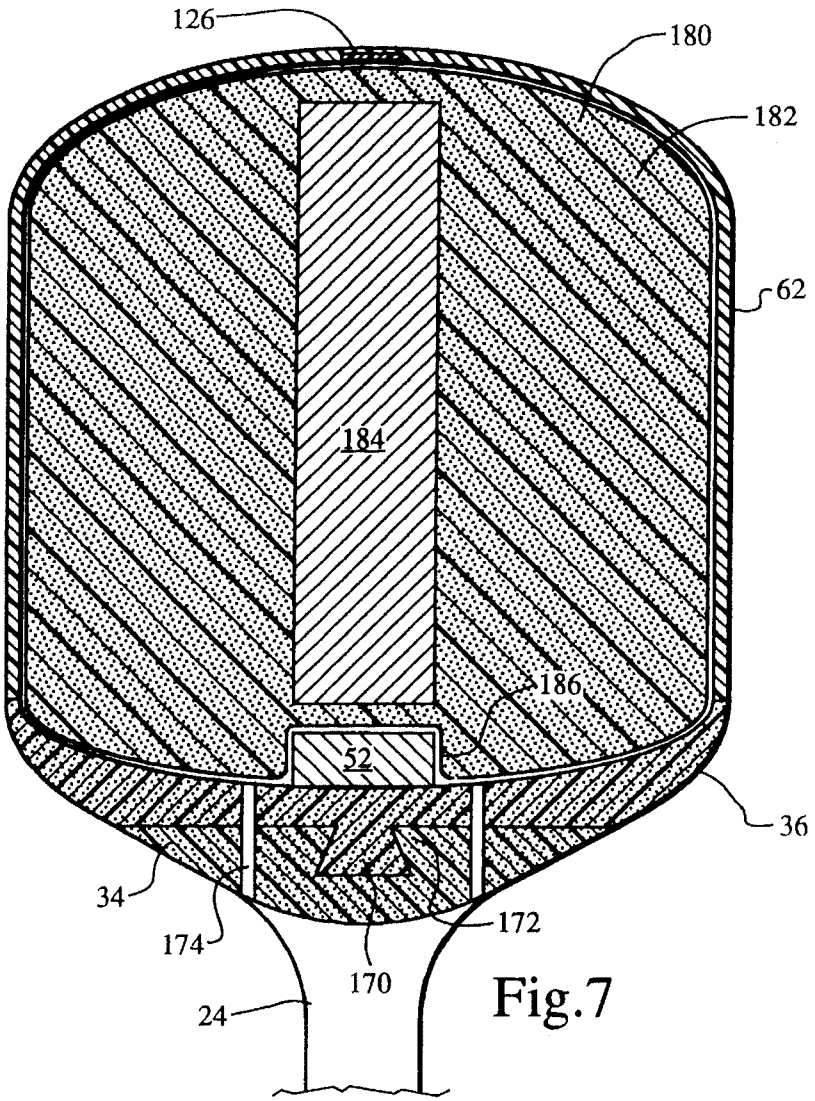
FIG. 7 is a cross section representation taken along line 7—7 in FIG. 2 and having a target insert adapted for use with broad head arrows.
Figure 6:
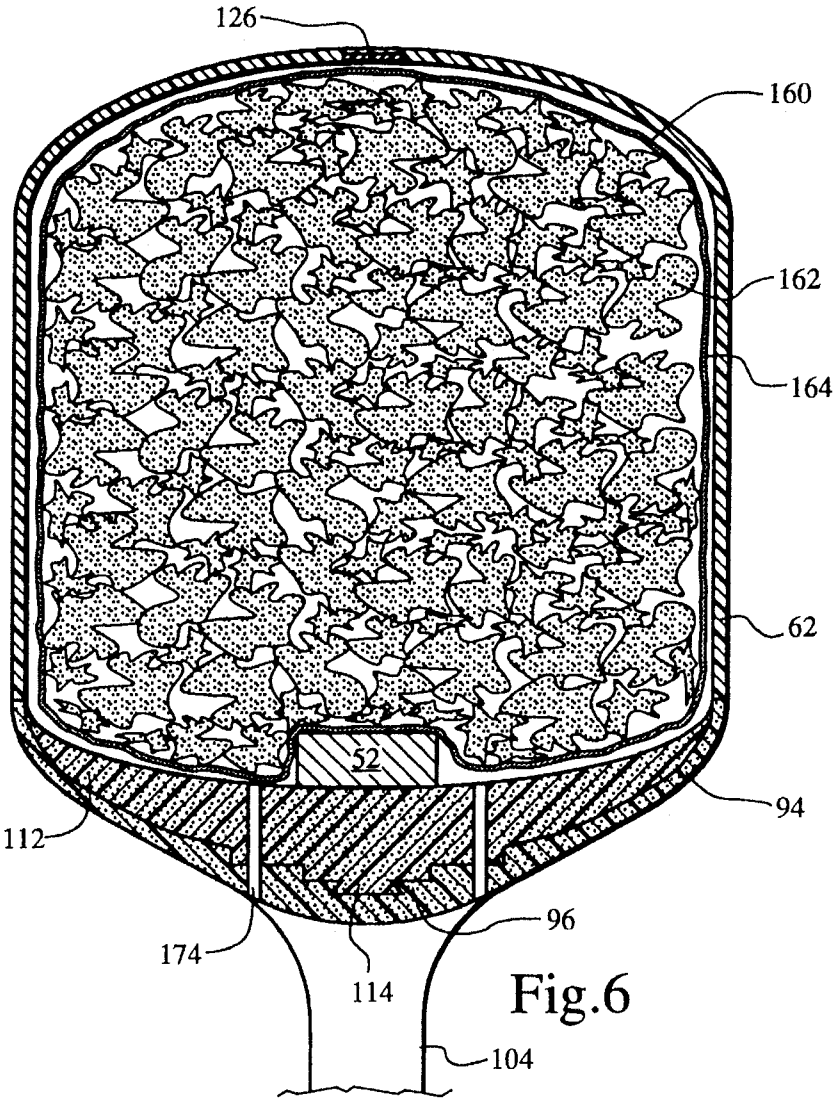
FIG. 6 is a cross section Illustration taken along lines 6—6 in FIG. 3.

Although it is not required, it is preferred that an elongate rectangular foam block 52, for example two to nine lbs/cu/ft ETHAFOAM, foamed plastic of expanded synthetic resin, preferably six lbs/cu/ft ETHAFOAM, be attached to the base of the recess 26 so as to extend along the center line or long axis of the recess and, as such, be sandwiched between the recess and lower surface 54 of the target insert 42 (FIGS. 6 and 7). This foam block 52 is designed to prevent arrows from passing through the archery target 10 between the recess 26 and lower surface 54 of the target insert 42. The arrow penetration prevention element or block 52 may be attached to the foam body 12 by an adhesive adapted for use with urethane foams, or by being molded into one of the front and rear body sections 18 and 20 during formation thereof.

It is preferred that the elongate rectangular block 52 be formed of six to nine lbs/cu/ft ETHAFOAM and is molded into one of the front or rear body sections. Alternatively, the block 52 can be constructed of two sections with the forward section being molded into the front body section of the foam body and the rearward section being molded into the rear body section of the foam body during the molding process used to produce the foam body sections.

Figure 4:
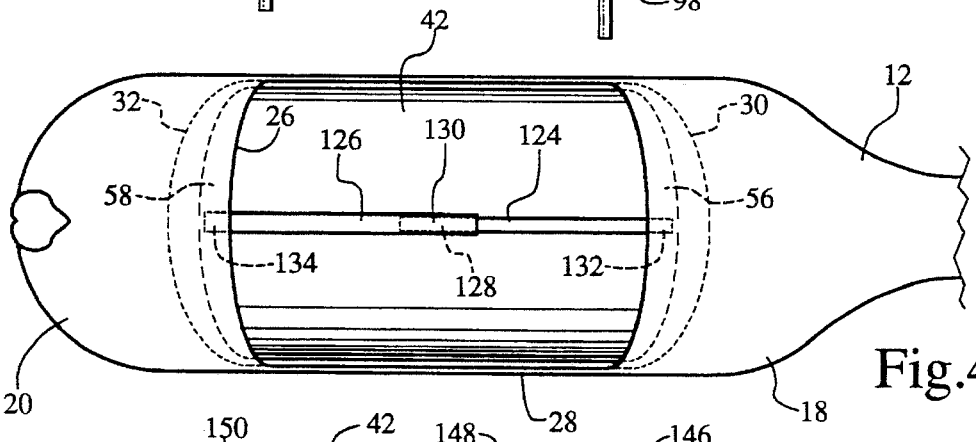
FIG. 4 is a top plan view illustration of the three-dimensional archery target of FIG. 2 with the body cover removed.

The target insert 42 has front and rear ends 56 and 58 which extend within the respective front and rear cavities 30 and 32 in the foam body 12 when the target insert 42 is placed in an operative position in the recess 26 (FIG. 4).

In the embodiment shown in FIG. 1 of the drawings, the body cover 44 is preferably formed of a fabric material, such as burlap, and the exterior surface of the foam body 12 is textured so that the body cover 44 and foam body 12 have a uniform exterior appearance which is lifelike in that it resembles the fur of a deer or game animal.

In accordance with one embodiment of the present invention, the head of foam body 12 includes antler receiving recesses for receiving the lower end of each of the removable antlers 14 and 16. However, it is contemplated that removable antlers 14 and 16 may be attached to the foam body 12 in an alternative manner, such as having a sharp point or a short length of wire extending from the base of each of the antlers and being adapted for being stuck into the head of foam body 12, or having respective lengths of wire being molded into the head of the foam body 12 and adapted for receiving the base of each of the removable antlers 14 and 16. It is preferred that the antlers 14 and 16 be formed of two to six pound polyurethane foam.

It is to be understood that the archery target 10 shown in FIG. 1 resembles a deer-like animal, such as a buck or antlered deer, and that the antlers may be removed so as to provide the appearance of a doe or antlerless deer. Although the foam body 12 is shown to be in the shape of a deer-like animal, it is to be understood that the archery target of the present invention is suited for use with a variety of foam bodies shaped to resemble game animals such as deer, antelope, bear, elk, moose, wolf, cougar, etc.

Although it is preferred that the foam body 12 include a head, front and rear shoulders, and front and rear legs, it is contemplated that the foam body could incorporate four legs with at least two of the legs providing for support of the three-dimensional archery target.

Figure 2:
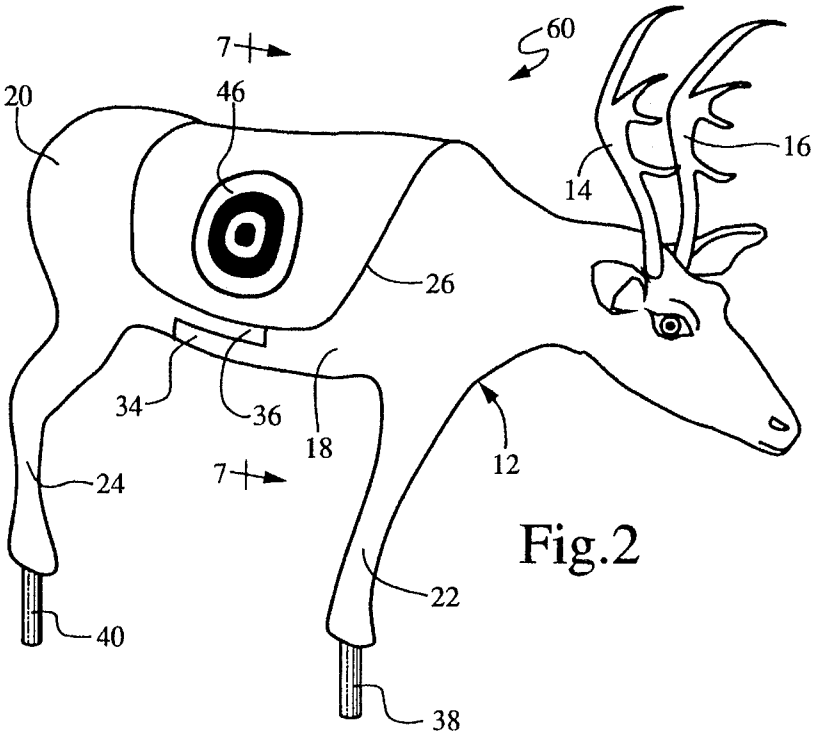
FIG. 2 is a perspective view illustration of an assembled and ready-to-use archery target in accordance with another embodiment of the present invention.

In accordance with another embodiment of the present invention and as shown in FIG. 2 of the drawings, a fully assembled and ready-to-use three-dimensional life-size animal-like archery target is generally designated by the reference numeral 60 and shown to include the same foam body 12 as the archery target 10 of FIG. 1 with the exception of straps 124 and 126 (FIG. 4). Target 60 includes a body cover 62 which differs from the fabric body cover 44 of FIG. 1 by being formed of molded polyurethane or cardboard and shaped so as to fit within the recess 26 with the exterior surface of the body cover in line with the exterior surface of the foam animal body 12 to provide a continuous outer surface to the archery target 60. The exterior surface of the body cover 62 and the exterior surface of the foam body 12 may be similarly textured so as to provide a lifelike and uniform appearance to the animal. For example, the exterior surfaces may be textured so as to resemble fur of an animal. The body cover 62 may include a bull's eye or scoring rings 46 the same as those of the body cover 44 of archery target 10 (FIG. 1).

Although it is preferred to use a body cover in conjunction with the foam animal body and target insert to provide a uniform appearance to the exterior surface of the archery target, it is contemplated that one could utilize the archery target without the body cover. The body covers 44 of FIG. 1 and 62 of FIG. 2 are removable and replaceable and formed of a material which allows for the penetration of arrows therethrough. In the shown embodiments, the body covers are made of either a fabric material such as ten ounce woven burlap or a relatively thin layer of polyurethane foam. For example, a one inch thick layer of molded polyurethane foam in the form of an inverted U and having an exterior edge which mates with the exterior edge of the insert receiving recess. As such, body covers 44 and 62 are made of relatively inexpensive materials which can withstand repeated strikes by arrows without disintegrating or falling apart.

Although it is preferred that the foam body 12 be releasably assembled, that is front and rear sections 18 and 20 be attached one to the other in a manner allowing for disassembly of the foam body 12 (dovetailed flanges, threaded fasteners, or nuts and bolts) and thereby facilitating shipping, transport and movement of the archery target from one location to another, it is contemplated that one may assemble the front and rear body sections 18 and 20 together in a permanent fashion, for example using solvents, or cement adapted for use with a urethane foam, or that instead the foam body 12 may be molded as a unitary, single piece animal-shaped foam body.

Figure 3:
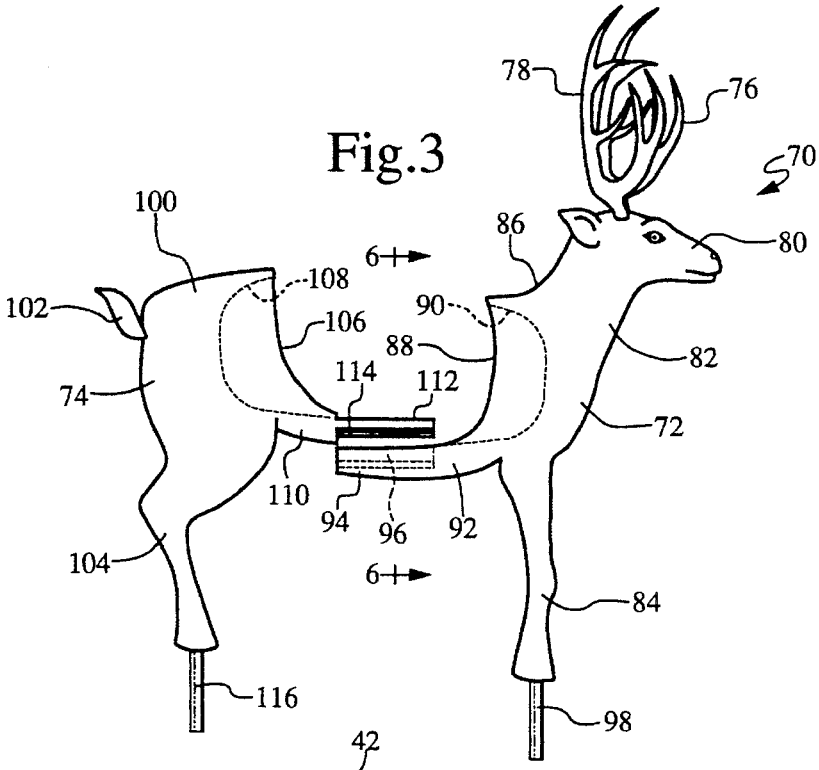
FIG. 3 is an exploded side view representation of the foam animal-simulating body in accordance with yet another embodiment of the present invention.

With reference to FIG. 3 of the drawings, an exemplary foam body generally designated 70 is shown to include front and rear body sections 72 and 74 and removable antlers 76 and 78. Front body section 72 includes a head 80, neck 82, front leg 84, front shoulder 86, front half 88 of an insert receiving recess, a front cavity 90, a front belly portion 92, a flange 94, and male dovetail element 96. A short section of metal pipe or conduit 98 is molded into the base of front leg 84. Rear body section 74 includes rear shoulder or hindquarters 100, a tail 102, rear leg 104, and a rear half 106 of the insert receiving recess, a rear cavity 108, a rear belly portion 110, a flange 112 and a female dovetail element 114. A short section of pipe or conduit 116 is molded into the base of rear leg 104. The removable antlers 76 and 78 are preferably molded from polyurethane foam and either molded to have sharp pointed lower ends which are stuck down into the head 80 or are molded so as to have wire sticking out of the lower ends thereof which can be stuck into and, as such, attached to the head 80.

In the embodiment shown in FIG. 3 of the drawings, the foam body 72 is shaped so as to represent a deer-like or antelope-like game animal and is formed of front and rear body sections 72 and 74 which are joined one to the other by placing the end of flange 94 adjacent the end of flange 112 and aligning the male and female dovetail elements 96 and 114 and then sliding one relative to the other so as to cause the female dovetail element to telescopically receive the male dovetail element and thereby join the front and rear sections 72 and 74 to form a unitary foam body 70 (FIG. 6). Using a horizontal dovetail arrangement to join the front and rear body sections 72 and 74 allows for the later disassembly of the foam body 70 when it is desired to move the archery target from one location to another or to transport the target in, for example, a small trunk of an automobile. Also, by separating the front and rear body sections 72 and 74, it is possible to reduce the weight of the individual components which need to be carried or transferred from one location to another. The horizontal dovetail arrangement 96 and 114, in combination with the vertical mounting elements 98 and 116 adapted to telescopically receive the upper end of elongate metal stakes driven into the ground, provide for a structurally stable assembled foam body which will not come apart during use of the archery target.

As illustrated in FIG. 4 of the drawings, the three-dimensional archery target 60 is shown with body cover 62 removed so as to provide a view of the target insert 42 within the insert receiving recess 26 and of a releasable target insert securing arrangement made up of straps 124 and 126 having respective overlapping ends 128 and 130 with at least a portion of the overlapping ends 128 and 130 having respective hook and eye elements. When the hook and eye elements of strap ends 128 and 130 are brought into contact with each other and pressed together, the straps 124 and 126 are releasably secured one to another. Opposite the ends 128 and 130, ends 132 and 134 of straps 124 and 126 are secured to the respective front and rear body sections 18 and 20 of the foam body 12 by having the ends 132 and 134 molded into the foam body sections. It is preferred that the insert securing straps 124 and 126 be secured to the front and rear body sections 18 and 20 by placing knots in the respective ends of the straps and moldlng the knotted ends into the body sections during the molding process for producing the front and rear body sections.

As shown with hidden lines in FIG. 4 of the drawings, the target insert 42 has a length or longitudinal dimension which is less than the overall length of recess 26 including cavities 30 and 32, but which is greater than the length of the central cutout or opening 28 of the insert receiving recess 26. As such, the ends 56 and 58 of the target insert 42 extend into the recesses 30 and 32 in the front and rear body sections 18 and 20. The target insert 42 is removed from the foam body 12 for either disassembly of the archery target 60 or to replace a worn target insert 42 with a new target insert by first pulling the ends 128 and 130 of the straps 124 and 126 apart thereby undoing or releasing the hook and eye portions, then sliding the target insert 42 toward the rear of the foam body so that the end 58 abuts with the surface of concave cavity 32. With the end 58 against the wall of cavity 32, the end 56 of the target insert 42 can be lifted up and out of the opening 28 of recess 26. Straps 124 and 126 are formed of a flexible material, such as nylon or cotton, and, as such, allow the target insert to pass thereby by bending or flexing out of the way of the insert.

To place an insert 42 within the recess 26 the above-described process is reversed is that straps 124 and 126 are flexed out of the way of opening 28, the end 58 of the insert 42 is dropped down into the opening 28 and stuffed back into the cavity 32 so that the end surface of the insert is in contact with the cavity wall, the front end 56 of the insert 42 is dropped down through the opening 28 and then the insert 42 is shifted forward so that both ends 56 and 58 are received within their respective cavities 30 and 32 of the foam body 12. Thereafter, ends 128 and 130 of straps 124 and 126 are brought into contact with one another and pressed together so as to form an attachment between the hook and eye elements on the straps.

Alternatively, the target insert 42 can be removed or replaced by disassembling the foam body 12 (separating the front and rear body sections), pulling out the old target insert, placing a new target insert between the body sections, and then assembling the foam body (Joining the front and rear body sections).

It is preferred that once the target insert 42 has been placed and secured within the insert receiving recess 26 that the body cover 62 be placed over the cutout 28 and pushed down against foam body 12 with the side edges of the body cover 62 abutting and mating with the outer edges of recess 26 (FIG. 2). Although a body cover is not required for the archery target to be functional (a bull's eye or scoring rings could be painted or printed on the side of target insert 42), it is preferred that a body cover (body cover 62 of FIG. 2 or body cover 44 of FIG. 1) be added to provide a uniform and lifelike appearance to the game animal.

Figure 5:
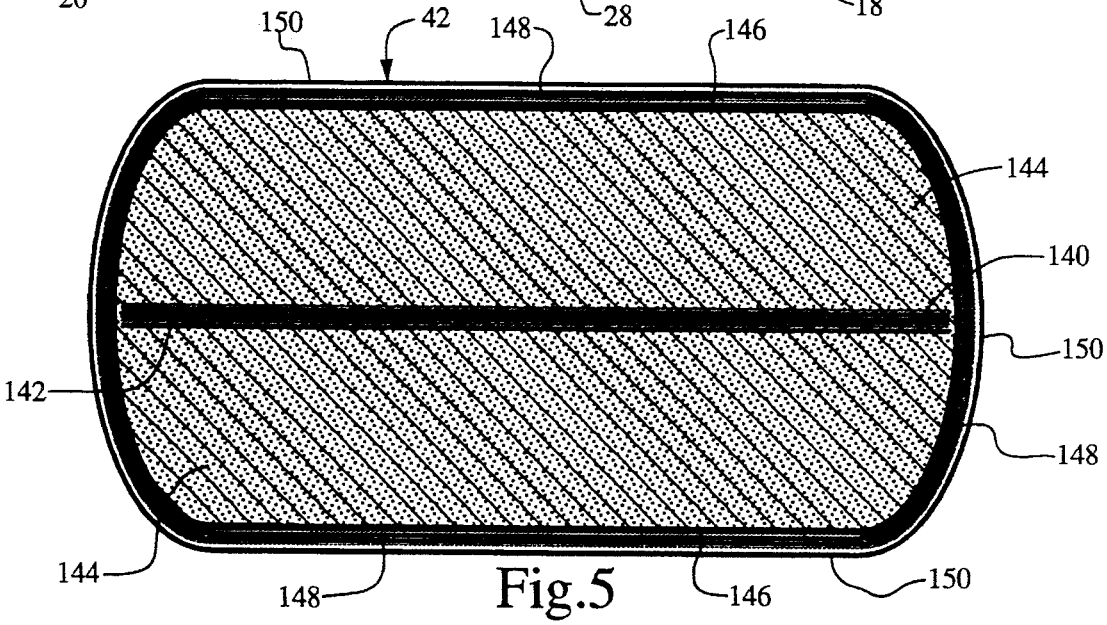
FIG. 5 is a longitudinal cross section representation through a target insert having a free floating central core.

In accordance with a preferred embodiment of the present invention as shown in FIG. 5 of the drawings, the target insert 42 adapted for use with field point or target head arrows includes a free floating central core 140 made up of a plurality of stacked sheets of a penetration resistant material, such as twenty ounce woven burlap fabric or woven nylon material, with each of the sheets aligned alone a common plane intended to be arranged in a vertical orientation within the archery target. FIG. 5 represents a horizontal or longitudinal cross section of the target insert 42 as shown in either FIGS. 1 or 4 of the drawings. The central core 140 is surrounded by compressed packing material 144, such as cotton molt. The compressed or tightly packed material 144 is contained within a moisture barrier such as a three mil polyethylene bag. The moisture barrier 146 is wrapped with a plurality of layers of mesh, screen, or net material, such as nylon mesh, having openings dimensioned to freely pass an arrow tip. For example, the nylon mesh 146 has openings greater than one-quarter by one-quarter of an inch, so that penetrating arrows are unlikely to hit and break the strands of the mesh. The mesh material 146 is covered by one or more layers of fabric material 148, such as ten ounce woven burlap fabric. Such a target insert 42 has a long service life and allows arrows to be easily removed. Once the arrow strikes the target insert, it is maintained in an orientation perpendicular to the front face of the target insert minimizing its exposure to subsequent arrows and thus preventing expensive arrow damage. The free floating central core 140 is oriented parallel to the front and back faces of the target insert and serves to absorb arrow impact without being penetrated. This further prevents expensive arrow damage.

In accordance with an exemplary embodiment of the target insert, the central core 140 is formed of eight sheets 142 of twenty ounce burlap folded over at their upper ends so as to form sixteen layers. The burlap fabric is available from Katy Bag Company of Pearson, Ga. The packing material 144 is preferably a compressed cotton molt having less than one and one-fourth inch strands of the type available from Smith Cotton Company of Blythevllle, Ark. The moisture barrier 146 is preferably a three rail polyethylene bag of a type available from Ace Bag Company from Newark, N.J. The mesh material or netting 148 is preferably wrapped around the sides of the insert at least twenty times and around the ends at least six times and is a nylon mesh having openings five-eighths by three-fourths of an inch. Such mesh is available from Internet, Inc. of Minneapolis, Minn. The outer covering 150 is preferably two layers of a coarse weave fabric material such as ten ounce burlap bags sealed at their openings by staples, hog rings sewing with heavy duty thread or the like. Suitable burlap bags are available from Katy Bag Company of Pearson, Ga.

A less expensive version of a target insert 160 adapted for field point or target head arrows is shown in FIG. 6 of the drawings to include a compressed packing material 162 such as rags, cloth pieces, burlap bags, fabric scraps, cotton molt or the like packed into a substantially cylindrical outer cover or case 164 formed of a fabric material such as two layers of a coarse weave fabric material, for example two ten ounce burlap bags sealed at their openings by staples, hog rings or by sewing with heavy duty thread or light cord.

Typically, burlap bags include a seam along one side. In accordance with a preferred embodiment, this seam of the burlap bags forming the outer cover 150 of target insert 42 is aligned with the top edge of the stacked sheets 142 of the central core 140. Thus, the side seam on the outer burlap bag 150 provides an indication of the top of the target insert which should be aligned so as to be located directly beneath the straps 124 and 126 (FIG. 4) when the target insert 42 is inserted into the target receiving recess 26 of the foam body 12. Thus, it is possible to insure that the free floating central core 140 is oriented vertically within the three dimensional archery target and will serve its intended purpose of absorbing the impact and resisting penetration of arrows which strike the target insert.

Since the target insert 42 is represented in FIG. 5 as being symmetrical in that it contains packing material 144 on both the front and rear sides of the central core 140, the target insert may be used to receive arrows directed at the archery target from either side of the game animal or, instead, if the target is only used for target practice from one side of the animal, the target insert may be rotated through 180° or may be removed from the target and reinserted with the opposite end (end 56 in cavity 32 instead of cavity 30) so that a worn side of the target insert may be exchanged for a fresh side, thus doubling the useful life of the insert.

Inasmuch as the three-dimensional archery target of the present invention is adapted for use in archery target practice from either side and, as such, may include a bull's eye, scoring ring, or depiction of vital organs on both sides of the body cover, the useful life of the target is approximately doubled since the target may be rotated through 180° and present a fresh face of the body cover, target insert, and foam body for which to receive arrows. Although the foam body 12 is not the primary aiming point for arrows during use, it is to be understood that stray, misfired, or inaccurate arrow shots may strike the foam body. As such, the foam body is preferably constructed of a foam material having a density heavy enough, for example six lbs/cu/ft polyurethane foam, to withstand numerous strikes by arrows without being torn apart or disintegrated.

In accordance with the present invention, the target insert 42 has a transverse or vertical cross section which may be substantially circular (FIG. 1) or substantially oval (FIG. 6) and is sized so as to be received within and substantially fill the insert receiving recess in the foam body (FIGS. 4 and 6).

In accordance with the embodiment represented in FIG. 7 of the drawings, the overlapping and interfitting flanges 34 and 36 of the front and rear body sections 18 and 20 respectively include horizontal male and female dovetail elements 170 and 172 which provide for alignment of the flanges 34 and 36 with respect to one another and for releasably securing the flanges together and thereby releasably securing the front and rear body sections 18 and 20 together. Further, flanges 34 and 36 include vertically aligned openings which serve as drain holes 174 to provide for the drainage of any moisture collected in the recess 26.

In accordance with the embodiment shown in FIGS. 3 and 6 of the drawings, flanges 94 and 112 of front and rear body sections 72 and 74 contain vertically aligned openings for forming drain holes or conduits 174 for draining moisture which collects in the recess 118.

With reference again to FIG. 7 of the drawings, a target insert 180 adapted for use with broad head arrows is constructed of a substantially cylindrical elongate section of polyurethane foam 182 having embedded therein an elongate, rectangular, ETHAFOAM core 184. In accordance with the preferred embodiment, the polyurethane foam 182 is six or less lbs/cu/ft polyurethane while the ETHAFOAM block 184 is constructed of six to nine lbs/cu/ft ETHAFOAM or a plurality of two or less lbs/cu/ft ETHAFOAM sheets laminated together with screen or mesh between the sheets. In accordance with the preferred embodiment, the target insert 180 includes an elongate rectangular recess 186 located along the center line of the bottom of the insert and adapted for receiving the foam block 52. It is to be understood that if the foam block 52 is not utilized, and as such is not present in the archery target, the target insert 180 may have a substantially circular or substantially oval cross section adapted to be received within the recess 26 and also substantially fill the recess.

The target inserts 42 and 160 are somewhat flexible and thereby deform when placed within the insert receiving recess 26 and accommodate the foam block 52. Thus, it is not necessary to provide an elongate rectangular recess in the base of either of the target inserts 42 or 160 to accommodate the rectangular block 52. Inasmuch as the target insert 180 is formed of a foam material which is semi-rigid, it is preferred to provide the elongate rectangular recess 186 in the base of the insert 180 and to remove and replace insert 180 by disassembling and assembling foam body 12 to eliminate the need to apply excessive pressure and force so as to deform the target insert 180 to fit within the recess 26 and accommodate the foam block 52. The ETHAFOAM core 184 of the target insert 180 is oriented vertically in the same fashion as the central core 140 of the target insert 42. As such, the ETHAFOAM core 184 provides for absorbing the impact and stopping the penetration of arrows through the insert 180. Since the target insert 180 is symmetrical with respect to the central core 184, it is adapted to be fired at from either side of the archery target or, if the archery target is only fired at from one side, to be removed from the target and rotated to provide a fresh side of the insert for target practice when one side has become worn, thus doubling the effective service life of the insert 180. Although the target insert 180 is especially adapted for use with broad head arrows, it may also be used with field point or target head arrows.

Figures 8, 9:
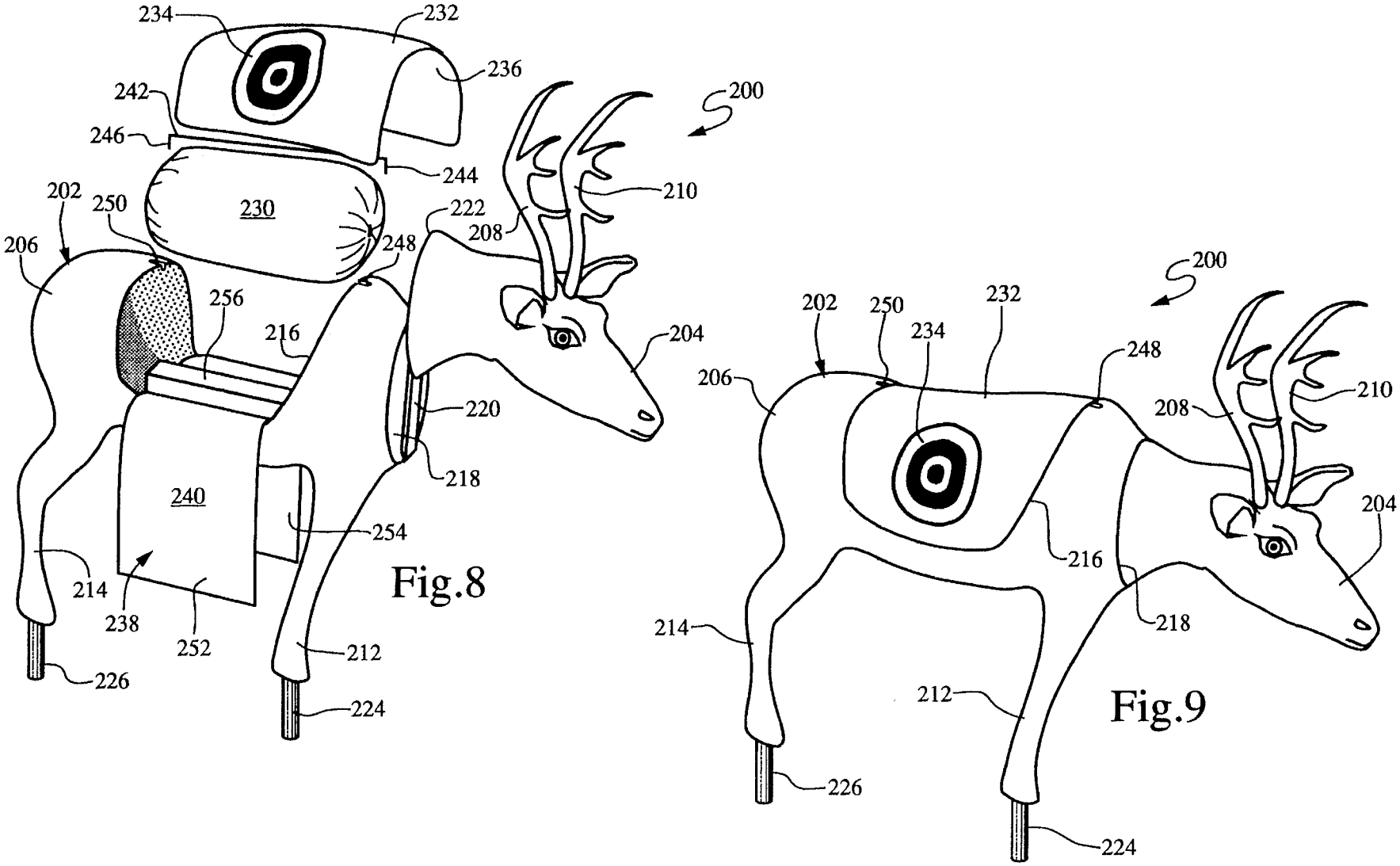
FIG. 8 is an exploded perspective view illustration of another embodiment of the archery target of the present invention.
FIG. 9 is an assembled perspective view representation of the archery target of FIG. 8.

In accordance with another exemplary embodiment of the present invention as shown in FIGS. 8 and 9 of the drawings, a three-dimensional life-size animal-simulating archery target is generally designated by the reference numeral 200 and shown to include a molded foam body 202 having a deer-like shape. The body 202 is made up of front arid rear body sections 204 and 206. Front body section 204 includes a head, neck and removable plastic antlers 208 and 210. Rear body section 206 has respective front and rear legs 212 and 214 and a target insert receiving recess 216 in the back of the animal. The foam body 202 is constructed of molded polyurethane foam having a density of from two to nine lbs/cu/ft, preferably six lbs/cu/ft.

The front and rear body sections 204 and 206 of foam body 202 are Joined together by a vertical dovetail arrangement 218 at the base of the neck of the animal. The dovetail arrangement 218 includes a tapered, flange 220 extending from the rear body section 206 and a corresponding tapered recess 222 in front body section 204 adapted to receive the flange 220 as the front section 204 is moved downwardly from the position shown in FIG. 8 to the position shown in FIG. 9. A section of steel pipe or conduit 224 and 226 is molded into the base of each of the legs 212 and 214 to provide for the mounting of the archery target 200 in an upright operative position for use, for example, over metal stakes that are driven into the ground.

The three-dimensional archery target 200 further includes an elongate, substantially cylindrical target insert 230 adapted to be received in and substantially fill the insert receiving recess 216 of foam body 202. The target insert 230 is identical to target insert 42 of FIGS. 1, 4 and 5. Although it is contemplated that, the target insert 230 may be replaced by the target insert 160 of FIG. 6 or 180 of FIG. 7. The target 200 further includes a body cover 232 for covering the target insert 230 and recess 216 so as to provide a uniform appearance to the exterior of the game animal. The body cover 232 includes a bull's eye, scoring rings or depiction of vital organs 234 on the exterior thereof to indicate the primary aiming point for arrows directed at the target 200. The body cover 232 is constructed of molded polyurethane foam, nine or less lbs/cu/ft, preferably six lbs/cu/ft, approximately 2 inches thick and has a concave inner surface 236 adapted to receive the insert 230.

The archery target 200 also includes a releasable target insert securing arrangement 238 including at least one elongate strip 240, a metal rod or wire 242 (⅛ to ¼ inch diameter steel rod) having L-shaped ends 244 and 246. The rod 242 is dimensioned so that each of the ends 244 and 246 is received within a respective recess 248 and 250 in the front and rear shoulders of the body section 206 when the target is fully assembled as shown in FIG. 9.

The elongate strip 240 is preferably one or more elongate strips of 10 to 20 ounce woven burlap fabric stacked one on top of another and laid lengthwise across the deer with even lengths 252 and 254 hanging down on either side. The strip 240 is secured to the base of the recess 216 by staples.

Although it is not required, it is preferred that an elongate rectangular foam block 256, for example two to nine lbs/cu/ft ETHAFOAM, preferably six lbs/cu/ft ETHAFOAM, be attached along with the strip 240 to the base of the recess 216 so as to extend along the center line or long axis of the recess. In this position, the block 256 is sandwiched between the recess 216 and lower surface of the target insert 230 when the target is assembled. The foam block 256 is designed to prevent arrows from passing through the archery target 200 between the recess 216 and lower surface of the target insert.

The insert 230, cover 232, strip 240, rod 242 and block 256 are designed to be relatively inexpensive, removable and replaceable items as compared to the foam animal body 202. In particular, it is contemplated that replacement target inserts and body covers will be sold together as a target replacement unit or component.

The target 200 is assembled and set up for use by placing two metal stakes into the ground separated by a distance equal to the distance between the conduits 224 and 226, placing the conduits 224 and 226 over the upper ends of the stakes protruding out of the ground and thereby standing rear body section 206 in an orientation substantially perpendicular to the ground in an upright position. Then, the front body section 204 is attached to the rear body section 206 by starting the upper end of the dovetail flange 220 into the lower end of dovetail recess 222 and sliding the front body section 204 downwardly until the two body sections are aligned. The burlap strip 240 is placed lengthwise across the recess 216 in rear body section 206 so that lengths 252 and 254 hang down on both sides. Foam block 256 is set atop the strip along the midline of the recess 216, and then the foam block and burlap strip are attached to the base of the recess by staples, nails, screws, glue or the like. The target insert 230 is positioned in the target insert receiving recess 216 so that the block 256 is sandwiched between the lower surface of the insert 230 and the base of the recess 216. Next, the ends 244 and 246 of wire 242 are pressed down into recesses 248 and 250, and the wire 242 is secured to the insert by staples, clips, sewing, or rings, such as hog rings which are passed around the wire and through the outer burlap layers of the insert. Then the flaps 252 and 254 of strip 240 are pulled up and around the insert 230 and secured to the wire 242 with sewing, staples, clips or rings, such as hog rings around the wire and through both of the flaps. The body cover 232 is then placed over the insert wire and strip to a position where the edges of the cover 232 mate with the edges of the recess 216. The cover 232 is then secured to the body section 206 by stapling or taping the outside edges of the cover 232 to the edges of the recess 216. The archery target 200 is completed by pushing the base of each of the plastic antlers 208 and 210 into predrilled holes in the top of the head of front body section 204.

The securing arrangement 238 including burlap strip 240 and wire 242 serves the purpose of holding the target insert into the recess so as to prevent the insert from popping out of the sides of the target upon arrow impact. The strip 240 also adds an extra layer of arrow stopping ability to the target. Although the strip 240 is shown as a single layer of burlap material, it is contemplated that two or more layers of burlap material or similar woven material may be used since the strip or strips must allow for arrow penetration and also be of a material which can withstand a multitude of arrow strikes without disintegrating.

In the embodiment shown in FIG. 8 and 9 of the drawings, the body 202 and cover 232 are preferably formed of molded polyurethane foam with the exterior surface of the body and cover coated or painted with a rubberized coating material or paint and textured so that the body and cover have a uniform exterior appearance which is lifelike in that it resembles the fur of a deer or game animal.

In accordance with one embodiment of the present invention, the head 204 of foam body 202 includes antler receiving recesses for receiving the lower end of each of the removable plastic antlers 208 and 210. However, it is contemplated that removable antlers 208 and 210 may be attached to the foam body 202 in an alternative manner, such as having a sharp point or a short length of wire extending from the base of each of the antlers and being adapted for being stuck into the lead of the foam body. Also, the antlers 208 and 210 may be formed of two to six pound polyurethane foam instead of plastic.

It is to be understood that the archery target 200 shown in FIGS. 8 and 9 resembles a deer-like animal, cinch as a buck or antlered deer, and that the antlers can be removed so as to provide the appearance of a doe or antlerless deer. Although the foam body 202 is shown to be in the shape of a deer-like animal, it is to be understood that the archery target of the present invention is suited for use with a variety of foam bodies shaped to resemble game animals such as deer, antelope, bear, elk, moose, wolf, cougar, etc., and could incorporate four legs with at least two of the legs providing for support of the three-dimensional archery target.

Although it is preferred to use the body cover 232 in conjunction with the foam animal body 202 and target insert 230 to provide a uniform appearance to the exterior surface of the archery target 200, it is contemplated that one could utilize the archery target without the body cover. Further, score rings or vital organ depictions can be painted or printed on the outer surface of each of the strip lengths 252 and 254 to provide an indication of the aiming point when using the target without the body cover.

Although it is preferred that the foam body 202 be releasably assembled, that is front and rear body sections 204 and 206 be attached one to the other in a manner allowing for disassembly of the foam body 202 (dovetailed flanges and/or threaded fasteners) and thereby facilitating shipping, transport and movement of the archery target 200 from one location to another, it is contemplated that one may assemble the front and rear body sections 204 and 206 together in a permanent fashion, for example using solvents, or cement adapted for use with a urethane foam, or that instead the foam body 202 may be molded as a unitary item wherein the front and rear body sections are both part of a single piece animal-shaped foam body.

With reference to FIGS. 10–14 of the drawings, an exemplary archery target generally designated 300 is shown to include a molded polyurethane foam body 302, target insert 304, and body cover 306. The foam body 302 is made up of front and rear body sections 308 and 310 joined by a dovetail arrangement 312. Front body section 308 includes a head and neck of the animal. Rear body section 310 includes a front shoulder, an insert receiving recess 314, front legs 316 and 318, a rear shoulder or hindquarters and rear legs 320 and 322. A short section of pipe or conduit 324 and 326 is molded, glued or pressed into the base of front and rear legs 316 and 322, respectively.

Figure 12:
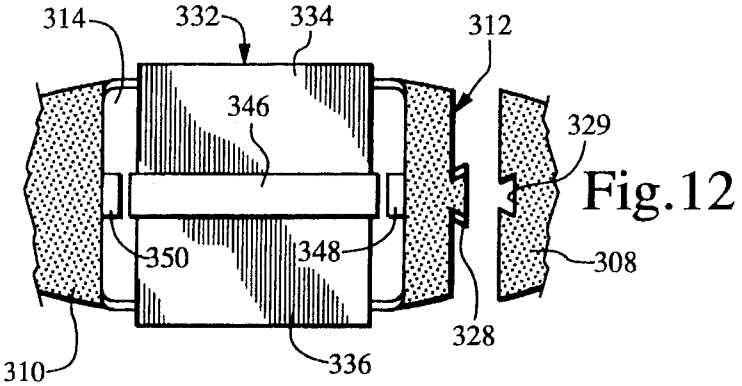
FIG. 12 is a partial top view representation of the foam body of FIG. 10.
Figure 13:
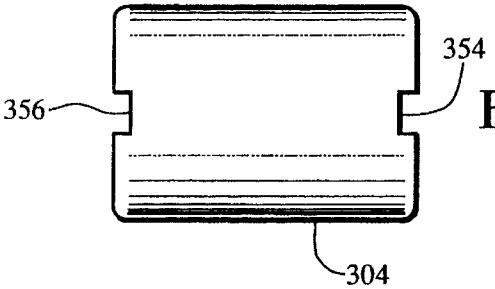
FIG. 13 is a top view illustration of the target insert of FIG. 10.
Figure 14:
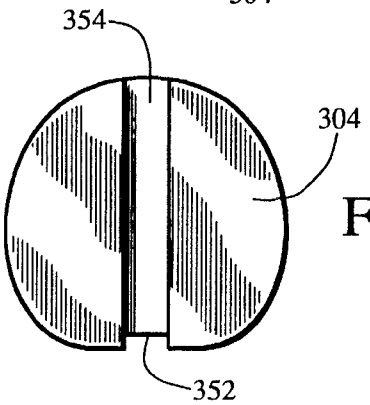
FIG. 14 is an end view representation of the target insert of FIG. 10.
Figure 10:
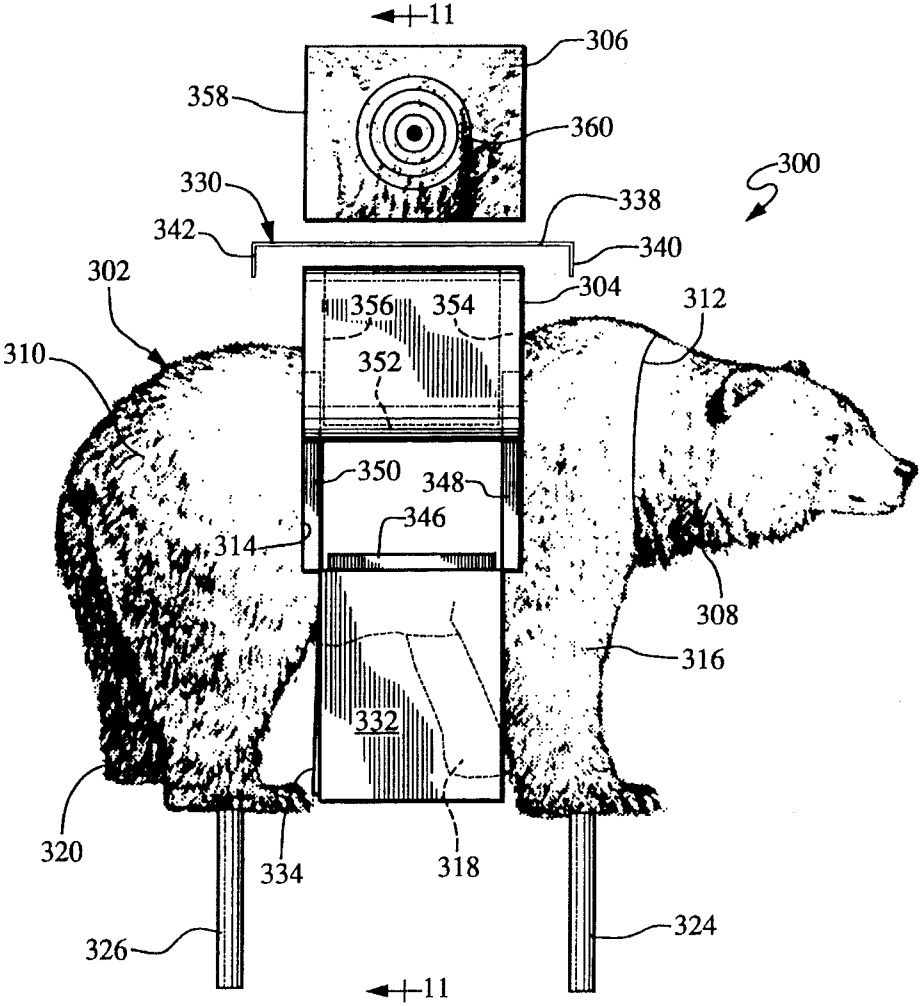
FIG. 10 is an exploded side view of still another embodiment of the archery target.
Figure 11:
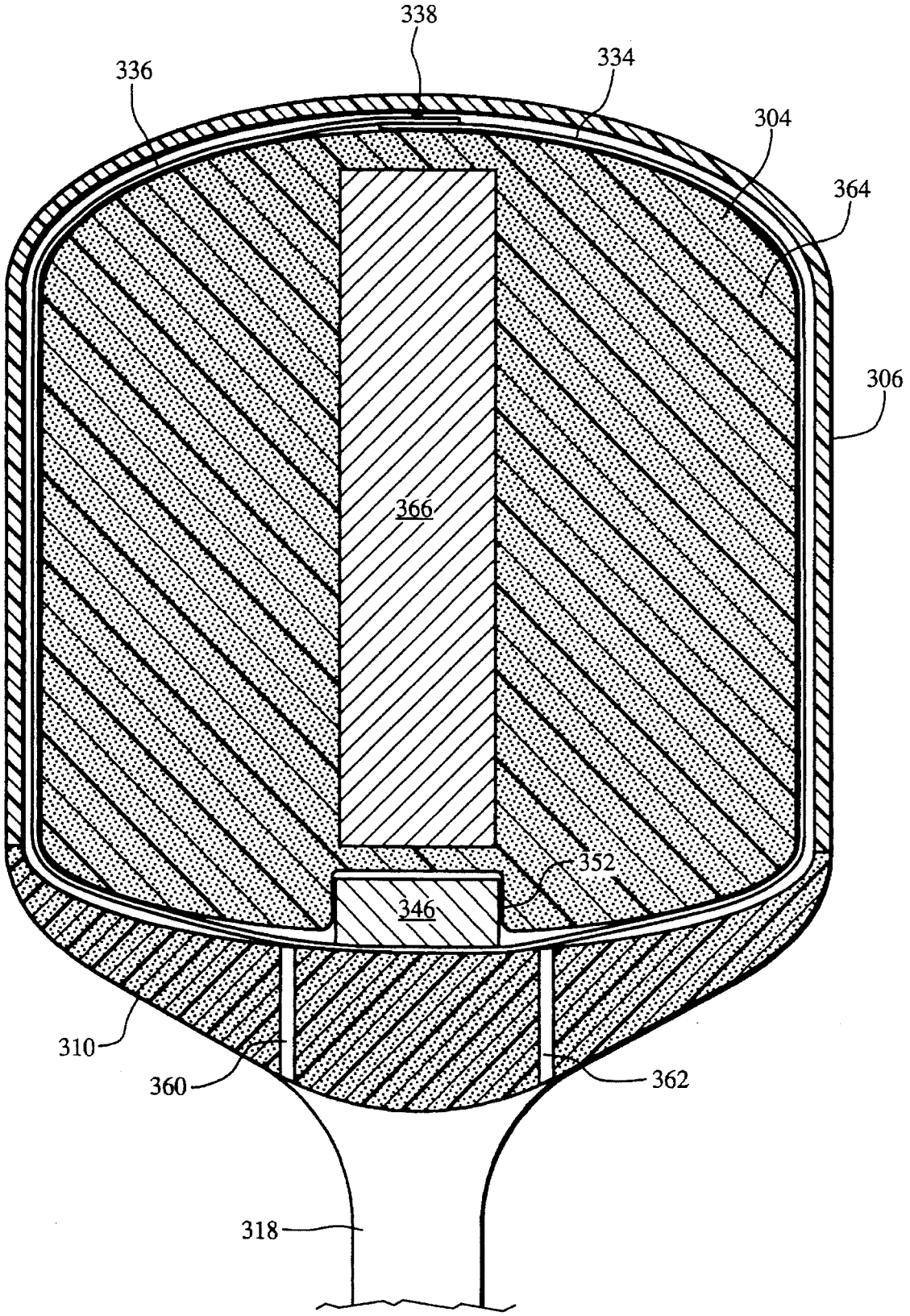
FIG. 11 is an assembled cross section illustration taken alone line 11—11 in FIG. 10.

In the embodiment shown in FIGS. 10–12 of the drawings, the foam body 302 is shaped so as to represent a life-size bear-like game animal. The front and rear body sections 308 and 310 are Joined one to the other by placing the base of the front section 308 adjacent the top of the rear section 310, aligning male and female dovetail elements 328 and 329 (flange and recess), and then sliding one relative to the other so as to cause the female dovetail element 329 to telescopically receive the male dovetail element 328 and thereby Join the front and rear sections to form a unitary foam body. The front and rear sections can be further secured together by a plurality of staples or threaded fasteners. Using a vertical dovetail arrangement and removable staples and/or threaded fasteners to join the front and rear body sections allows for the later disassembly of the foam body when it is desired to move the archery target 300 from one location to another or to transport the target in, for example, a small trunk of an automobile. Also, by separating the front and rear body sections, it is possible to reduce the weight of the individual components which need to be carried or transferred from one location to another.

As illustrated in FIG. 10 of the drawings, the three-dimensional archery target 300 is shown partially disassembled with body cover 306 raised so as to provide a view of the target insert 304, insert receiving recess 314 and of a releasable target insert securing arrangement 330. The securing arrangement 330 is made up of an elongate fabric strip 332 having respective ends 334 and 336 and a wire, rod or bracket 338 having L-shaped ends 340 and 342. Elongated strip 332 is formed of one or more sheets, preferably two sheets, of ten to twenty ounce burlap fabric laid lengthwise across the bear with even lengths hanging on both sides thereof and is secured to the base of the recess 314 by nails, screws, or staples.

An ETHAFOAM block 346 is placed on top of strip 332 along the center line of recess 314 and attached to the base of the recess by nails, screws or staples. The foam block 346 is aligned with vertically oriented protrusions 348 and 350 extending from the sides of recess 314 and located along the center line of the recess. Foam block 346 and protrusions 348 and 350 prevent arrows from passing between the target insert 304 and foam body 302. Although foam block 346 could be molded into the recess 314 like protrusions 348 and 350, it is preferred that the block 346 be made replaceable and of a dense material such as ethafoam since it is located in an area of the target which receives numerous strikes by arrows. In accordance with one example, block 346 and protrusions 348 and 350 are about 1 or 2 inches high, 2 to 4 inches wide and 10 or more inches long.

Although target insert 304 is shown in FIGS. 10–14 as a molded foam insert specially adapted for us with broad headed arrows, it is to be understood that the foam body 302 is adapted for use with inserts such as insert 230 shown in FIG. 8 and insert 160 shown in FIG. 6 of the drawings. Target insert 304 has a substantially cylindrical or oval cross-section and includes an elongate recess 352 alone its base adapted to receive the foam block 346 and vertically oriented elongate recess 354 and 356 in each of its ends adapted for receiving respective foam protrusions 348 and 350.

Body cover 306 is a molded polyurethane foam item, preferably one to two inches thick, having a concave inner surface 358 adapted to receive the target insert 304, and having score rinse 360 or vital organs painted or printed on the exterior surface to provide an indication of the primary aiming point for the target 300.

With reference again to FIGS. 10 and 11, the insert 304 is placed in an operative position within the recess 314, by placing the base of target insert 304 adjacent the top of recess 314, aligning recesses 354 and 356 with protrusions 348 and 350, and then pushing the insert 304 down into recess 314 so that the bottom of the insert abuts with strip 332, recess 352 receives block 346, and the top of the insert is flush with the top of protrusions 348 and 350. Next, wire 338 is pushed down on top of insert 304 with ends 340 and 342 pushed into foam body 302 so that the wire 330 abuts with the upper surface of insert 304. Thereafter, ends 334 and 336 of strip 332 are wrapped up and around insert 304 and overlap in the area of wire 338. Then, ends 334 and 336 are attached to wire 338 by metal fasteners such as clips or hog rings, staples, or sewn with heavy duty thread or light cord. Lastly, body cover 306 is placed over the strip 332, wire 338 and insert 304 and pushed down into position so as to be fully received within recess 314 with the edges of the body cover abutting with the edges of recess 314. The body cover is secured to foam body 302 by, for example, stapling the edges of the body cover to the edges of the recess 314.

The insert 304, fabric strip 332, foam block 346, wire 338, and body cover 306 are removable and replaceable items. Insert 304 is removed and replaced by removing the staples holding the body cover 306 to the recess 314, removing the body cover 306, removing the fastening elements securing the strip ends 334 and 336 to wire 338, pulling the ends 334 and 336 away from the insert 304, removing the wire 338, and then lifting the insert 304 out of recess 314. Additionally, if ETHAFOAM block 346 or fabric strip 332 need also to be replaced, they are removed from recess 314 by removing the staples holding them therein.

In accordance with an alternative embodiment of the present invention, the wire 338 is eliminated from archery target 300 by adding mating hook and eye strips to the respective ends 334 and 336 of fabric strip 332 so that the insert 304 is releasably fixed within recess 314 by overlapping the ends of strips 334 and 336 in a manner providing for the interlocking of respective hook and eye fasteners secured to the respective ends.

Although the body cover 306 is not required for the archery target 300 to be functional (a bull's eye or scoring rings could be painted or printed on the side of strip ends 334 and 336), it is preferred that the body cover 306 be added to provide a uniform and lifelike appearance to the game animal body 302. The exterior surface of body 302 and cover 306 are either molded in a manner providing a textured or life-like fur appearance, painted or coated to provide the desired appearance (color and/or texture).

Inasmuch as the three-dimensional archery target 300 of the present invention is adapted for use in archery target practice from either side and, as such, may include a bull's eye, scoring ring, or depiction of vital organs on both sides of the body cover 306, the useful life of the target is approximately doubled since the target may be rotated through 180° to present a fresh face of the body cover 306, target insert 304, and foam body 302 to receive arrows. Although the foam body 302 is not the primary aiming point for arrows during use, it is to be understood that stray, misfired, or inaccurate arrow shots may strike the foam body. As such, the foam body 302 and cover 306 are preferably constructed of a foam material having a density heavy enough, for example six lbs/cu/ft polyurethane foam, to withstand numerous strikes by arrows without being torn apart.

With reference to FIG. 11 of the drawings, rear body section 310 includes vertical openings 360 and 362 which serve as drain holes for the drainage of any moisture collected in the recess 314.

As illustrated in FIGS. 10–14 of the drawings, the target insert 304 is adapted for use with broad head arrows and is constructed of a substantially oval elongate section of polyurethane foam 364 having embedded therein an elongate, rectangular, ethafoam core 366. In accordance with the preferred embodiment, the polyurethane foam 364 is six or less lbs/cu/ft polyurethane while the ethafoam block 366 is constructed of six to nine lbs/cu/ft ethafoam or a plurality of two or less lbs/cu/ft ethafoam sheets laminated together with screen or mesh between the sheets. In accordance with the preferred embodiment, the target insert 304 includes the elongate rectangular recesses 352, 354 and 356 located along the center line of the bottom and sides of the insert and adapted for receiving the foam block 346 and protrusions 348 and 350. It is to be understood that if the foam block 346 is not utilized or if the insert receiving recess 314 does not include protrusions 348 and 350, the target insert 304 may have a substantially circular or oval cross section without any recesses and be adapted to substantially fill the insert receiving recess 314.

The target inserts 42 and 160 are somewhat flexible and thereby would deform when placed within the insert receiving recess 314 and accommodate the foam block 346 and protrusions 348 and 350. Thus, it is not necessary to provide an elongate rectangular recess in the base of either of the target inserts 42 or 160. Inasmuch as the target insert 304 is formed of a foam material which is semi-rigid, it is preferred to provide the elongate rectangular recesses 352, 354 and 356 in the insert 304 to eliminate the need to apply excessive pressure and force so as to deform the target insert 304 to fit within the recess 314 and accommodate the foam block 346 or protrusions 348 and 350. The ethafoam core 366 of the target insert 304 is oriented vertically in the same fashion as the central core 140 of the target insert 42. As such, the ETHAFOAM core 366 provides for absorbing the impact and stopping the penetration of arrows through the insert 304. Since the target insert 304 is symmetrical with respect to the central core 366, it is adapted to be fired at from either side of the archery target or, if the archery target is only fired at from one side, to be removed from the target and rotated to provide a fresh side of the insert for target practice when one side has become worn, thus doubling the effective service life of the insert 304. Although the target insert 304 is especially adapted for use with broad head arrows, it may also be used with field point or target head arrows.

In accordance with another aspect of the present invention, a three-dimensional life-size game animal-simulating archery target system for use with both broad head and field point arrows includes at least one foam animal body and at least two target inserts, one especially adapted for use with broad head arrows and another especially adapted for use with field point or target point arrows. Additionally, such a system includes at least one body cover, at least two elongate metal stakes, and an elongate ETHAFOAM block for placement in between the target insert and foam body recess for preventing penetration of arrows through the archery target. Such an archery target system provides the user with the ability to carry out archery target practice and hunting preparation using a life-size game animal-simulating archery target. By placing the target insert adapted for use with field point or target point arrows in the archery target the user can fire field point or target head arrows at the target and then, by replacing the target insert with a target insert adapted for use with broad head arrows, the user can fire broad head arrows at the archery target. Thus, a user can use field point or target head arrows to practice and then, one achieving confidence with the field point and target head arrows, can switch to using broad head arrows and get a true simulation of arrow action in the field using the three-dimensional archery target system of the present invention.

The primary aiming point for the archery target of the present invention is the central area of the target insert. Thus, the central area of the target insert is to correspond to a kill area, vital area, or vital portions of the game animal represented by the foam body of the archery target. Hence, it is contemplated that the target insert receiving recess in the foam body may be located in slightly different areas of the foam body depending on the particular game animal and posture of the game animal depicted by the foam body.

Some of the advantages provided by the three-dimensional animal-simulating archery target of the present invention include ease of removal of arrows from the target inserts and body covers, target inserts can be constructed with either circular or oval transverse cross sections to adapt to different foam bodies representing different game animals, relatively easy to assemble and disassemble, lightweight, provides a lifelike game animal appearance, and, as such, improves hunting preparation and increases the enjoyment of archery target practice, is structurally sound when assembled and will withstand extended use without coming apart, disintegrating, or requiring repair, has an extended service life due to the incorporation of replaceable target inserts and body covers, is made of a rugged construction which will withstand numerous assemblies, disassembles and transportation of the target from one location to another, the replaceable target inserts and body covers are relatively inexpensive components and, as such, provide for a reduced cost of operating and maintaining the archery target.

It is contemplated that the body cover may be constructed of molded foam, such as polyurethane, having a density of two to six lbs/cu/ft, fabric, such as burlap, or cardboard.

With reference again to FIG. 5 of the drawings, the target insert 42 is produced using a cylindrical jig having a circular or oval cross section depending on the desired cross section of the target insert. For example, a cylindrical jig having a circular cross section can be a cylindrical barrel or drum having an inner diameter slightly less than the desired outer diameter of the finished target insert. Next, a heavy duty plastic bag is inserted in the cylindrical jig with a portion of the bag extending beyond the upper edge of the jig and being folded over the top edge so as to provide easy access to the interior of the bag. Then, eight sheets of twenty ounce burlap are folded over a cylindrical rod or dowel along their midsection and hung down into the jig along a plane bisecting the center of the jig. With the dowel resting on the top edge of the jig, the sheets extend from the top to the bottom of the jig.

Following placement of the burlap sheets, high grade cotton molt is stuffed down along the sides of the sheets and packed tightly so as to fill the space between the sides of the sheets and the plastic bag. Once the bag has been packed with cotton packing, the dowel is removed from the sheets and the top edges of the plastic bag are brought over themselves and secured with transparent packing tape so as to form an integral cylindrical item made up of the stacked sheets, cotton packing, and plastic bag serving as a moisture barrier.

Next, the cylindrical item is wrapped tightly with six layers of nylon netting wrapped around the long dimension of the item and, thereby, covering the ends. Then it is wrapped tightly with twenty or more layers of nylon netting around the sides of the item so as to form concentric circles with the longitudinal axis of the target insert. After being wrapped with the nylon netting, the item is inserted into a first burlap sack end first so that the burlap sack tends to secure the nylon netting around the item. Then the item is inserted end first into another ten ounce burlap sack so the target insert has two layers of burlap serving as an outer cover.

The insert is completed by securing the top edges of the burlap sack to the interior components of the target by stapling the burlap with staples which extend through the burlap layers and into the plastic bag and cotton packing. Alternatively, the burlap bags may have their top ends secured by use of hog rings or by being sewn shut.

Thus, it will be appreciated as a result of the present invention, a highly effective, three-dimensional, animal-simulating archery target having a removable target insert in the primary aiming point of the target is provided by which the principal objective, among others, is completely fulfilled. It is contemplated, and will be apparent to those skilled in the art from the preceding description and accompanying drawings, that modifications and/or changes may be made in the illustrated embodiments without departure from the present invention. Accordingly, it is expressly intended that the foregoing description and accompanying drawings are illustrative of preferred embodiments only, not limiting, and that the true spirit and scope of the present invention be determined by reference to the appended claims.

What is claimed as invention

1. A three-dimensional animal-simulating archery target comprising:

a foam animal body shaped in the form of an animal so as to simulate all animal at least when viewed from the side, and having a target insert receiving recess located in the kill zone of the animal, a substantially cylindrical, removable arrow receiving target insert adapted to be received in and substantially fill said target insert receiving recess, and releasable securing means for securing said target insert in an operative position in said recess during use of said archery target and for allowing said target insert to be removed from said recess to provide for removal of said target insert, whereby said target insert is located in the primary aiming point and the intended target for arrows during use of the archery target so that during extended use the foam animal body remains intact while the target insert is damaged by repeated arrow strikes and replaced as needed.

2. The archery target as recited in claim wherein said releasable securing means comprises at least one elongate strip positioned transverse to said animal body and secured to the base of the insert receiving recess with substantially equal lengths of said strip extending from said insert receiving recess, and means for securing the ends of each of said lengths of said strip to each other to surround the target insert in said insert receiving recess and thereby secure the target insert in an operative position in said target.

3. The archery target as recited in claim 2 further comprising a removable arrow penetrating body cover adapted for placement over said target insert and providing a uniform appearance to the exterior surface of the foam animal body.

4. The archery target as recited in claim 3 wherein said body cover is made of molded foam and dimensioned so as to fit within said recess and provide a continuous contour to the exterior of the animal.

5. The archery target as recited in claim 4 wherein the exterior of said foam body and said body cover are painted and textured to provide the animal with a uniform and life-like appearance.

6. The archery target as recited in claim 1 wherein said target insert comprises a substantially cylindrical elongate section of foam adapted for receiving broad head arrows.

7. The archery target as recited in claim 1 wherein said target insert comprises a substantially cylindrical elongate fabric covered item filled with packing material and adapted for receiving field point arrows.

8. The archery target as recited in claim 7 wherein said packing material comprises compressed cotton molt.

9. The archery target as recited in claim 7 wherein said elongate fabric covered item further includes a free floating central core formed by a plurality of stacked sheets of penetration resistant material, said sheets being oriented along a common plane and serving to absorb arrow impact without being penetrated, said central core being surrounded by compressed packing material disposed within a moisture barrier, said moisture barrier having a plurality of layers of mesh material wrapped therearound and said mesh material being covered by said fabric.

10. The archery target as recited in claim 1 wherein said foam body is formed of molded front and rear body sections Joined together by a dovetail joint.

11. A three-dimensional animal-simulating archery target comprising:

a foam animal body shaped in the form of an animal so as to simulate an animal at least when viewed from the side, and having a target insert receiving recess located in the kill zone of the animal, a substantially cylindrical, removable arrow receiving target insert adapted to be received in and substantially fill said target insert receiving recess, and releasable securing means for securing said target insert in an operative position in said recess during use of said archery target and for allowing said target insert to be removed from said recess to provide for removal of said target insert, wherein said releasable securing means comprises at least one elongate strip positioned transverse to said animal body and secured to the base of the insert receiving recess with substantially equal lengths of said strip extending from said insert receiving recess, means for securing the ends of each of said lengths of said strip to each other to surround the target insert in said insert receiving recess and thereby secure the target insert in an operative position in said target, wherein said releasable securing means further includes an insert stabilizing means comprising an elongate rigid item adapted to be placed across the top of the target insert received in said insert receiving recess and having ends extending into the foam animal body adjacent said recess, whereby said target insert is located in the primary aiming point and the intended target for arrows during use of the archery target so that during extended use the foam animal body remains intact while the target insert is damaged by repeated arrow strikes and replaced as needed.

12. The archery target as recited in claim 11, wherein said stabilizing means comprises an elongate metal rod having L-shaped ends adapted to be pressed into said foam animal body.

13. The archery target as recited in claim 12 wherein said elongate strip is formed of at least one layer of woven burlap fabric and the ends of said elongate strip are releasably secured to said metal rod by a plurality of removable metal rings.

14. A three-dimensional animal-simulating archery target comprising:

a foam animal body shaped in the form of an animal so as to simulate an animal at least when viewed from one side, and having a target insert recess located in the kill zone of the animal, wherein said insert receiving recess includes front and rear foam protrusions for preventing arrows from passing through said target between the ends of the target insert and the recess, a substantially cylindrical, removable arrow receiving target insert adapted to be received in and substantially fill said target insert receiving recess, and releasable securing means for securing said target insert in an operative position in said recess during use of said archery target and for allowing said target insert to be removed from said recess to provide for removal of said target insert, whereby said target insert is located in the primary aiming point and the intended target for arrows during use of the archery target so that during extended use the foam animal body remains intact while the target insert is damaged by repeated arrow strikes and replaced as needed.

15. The archery target as recited in claim 14 wherein said target insert includes a respective recess in each end thereof adapted to receive one of said protrusions.

16. A three-dimensional animal-simulating archery target comprising:

a foam animal body shaped in the form of an animal so as to simulate an animal at least when viewed from the side, and having a target insert receiving recess located in the kill zone of the animal, a substantially cylindrical removable arrow receiving target insert adapted to be received in and substantially fill said target insert receiving recess, an elongate rectangular block of foam secured to the base of said recess for preventing the passage of arrows through said archery target between the bottom of the target insert and said recess, and releasable securing means for securing said target insert in an operative position in said recess during use of said archery target and for allowing said target insert to be removed from said recess to provide for removal of said target insert, whereby said target insert is located in the primary aiming point and the intended target for arrows during use of the archery target so that during extended use the foam animal body remains intact while the target insert is damaged by repeated arrow strikes and replaced as needed.

17. A replaceable archery target insert for use with a life size three-dimensional animal-simulating archery target having an insert receiving recess located in a kill area of the animal comprising:

a substantially cylindrical elongate section of urethane foam having a rectangular ethafoam core along a diameter of the cylindrical section and adapted for receiving broad head arrows.

18. The insert as recited in claim 17, wherein said insert includes an elongate recess in each end and along the bottom thereof for accommodating corresponding protrusions in the insert receiving recess of the target.

* * * * *